United States Patent [19]

Hornak

[11] 4,243,255

[45] Jan. 6, 1981

[54] LOW SILHOUETTE ADJUSTABLE LATCH WITH SECONDARY LOCK

[75] Inventor: Alexander Hornak, Ramsey, N.J.

[73] Assignee: Rexnord Inc., Milwaukee, Wis.

[21] Appl. No.: 27,623

[22] Filed: Apr. 6, 1979

[51] Int. Cl.[3] ..... E05C 5/02

[52] U.S. Cl. ..... 292/113; 292/210; 292/DIG. 49

[58] Field of Search ..... 292/113, 210, 247, DIG. 31, 292/DIG. 49

[56] References Cited

U.S. PATENT DOCUMENTS

| | | | |
|---|---|---|---|
| 1,400,953 | 12/1921 | Hennicke | 292/247 |
| 1,898,742 | 2/1933 | Phillips | 292/113 X |
| 3,936,082 | 2/1976 | Swanson | 292/113 |
| 3,998,481 | 12/1976 | Anthone | 292/113 X |

FOREIGN PATENT DOCUMENTS

| | | | |
|---|---|---|---|
| 87172 | 8/1936 | Sweden | 292/113 |

*Primary Examiner*—Richard E. Moore

[57] ABSTRACT

A tension latch, embodying an over-center latching principle, includes means for adjusting the latch tension in the fully closed and latched position. The adjustment means is readily accessible through a channel-like opening formed by the latch handle. The same portion of the latch handle contains a secondary locking mechanism which is laterally offset from the adjustment means and is activated from the side of the handle, thereby maintaining complete access for tension adjustment. The lateral mounting and action of the locking mechanism allows the low profile of the latch to be maintained.

6 Claims, 3 Drawing Figures

Fig. 1
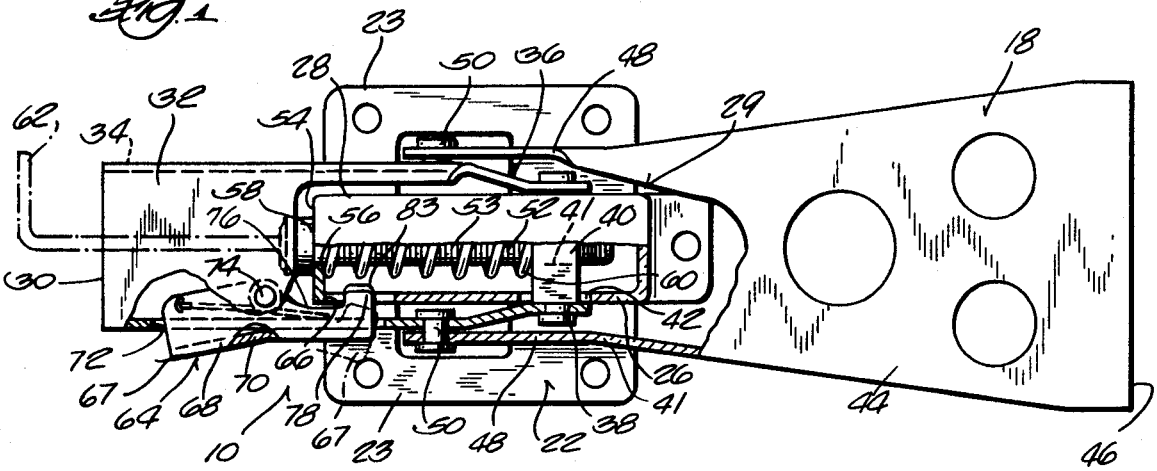
Fig. 2
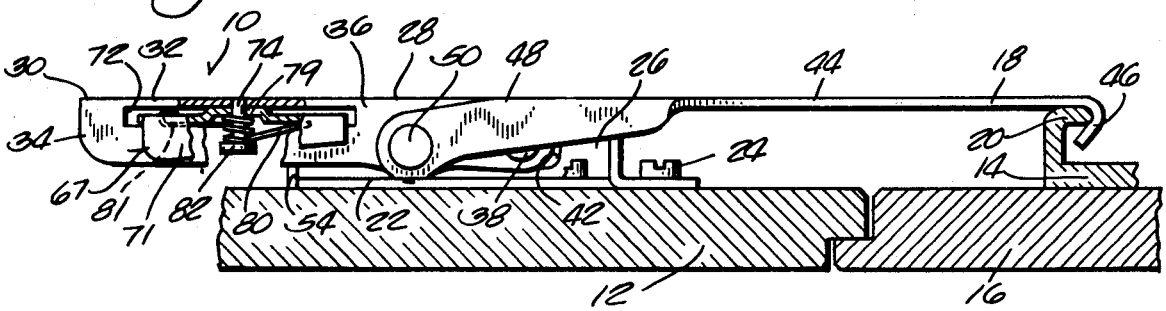
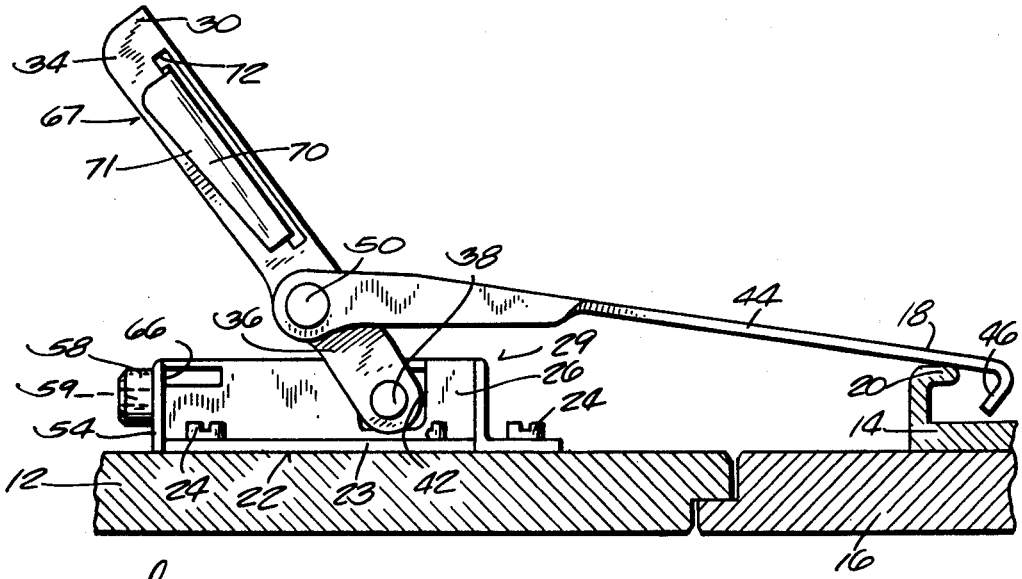
Fig. 3

LOW SILHOUETTE ADJUSTABLE LATCH WITH SECONDARY LOCK

BACKGROUND OF THE INVENTION

The present invention relates to the field of latches of the type particularly adaptable for joining and securing two adjacent and generally planar members. More particularly the invention pertains to an over center or toggle type latch including a separate drawhook and activating handle operatively attached to a base and additionally having means to adjust the latch tension and means to secure the latch in a fully closed position against accidental opening.

Latches of this general construction and including the various features described above are well-known in the art. For example, U.S. Pat. No. 3,936,082 discloses an overcenter tension latch with an anti-release or secondary locking mechanism. Also disclosed therein are means for varying the tension in the latch. However, the secondary lock is activated by the same general motion employed in raising the handle since it operates generally in the same direction as the movement of the handle. Also, the adjustment means is not readily accessible when the latch is in the closed position and, as a result, tension adjustments must be made in an open position with trial and error methods employed to reach the proper tension. U.S. Pat. No. 3,237,978 discloses a similar type of latch, including a secondary locking mechanism and a tension adjustment means. Again, however, the secondary locking means operates in the same direction as handle movement when the latter is lifted to open the latch. Such unidirectional movement of the secondary locking mechanism and the handle itself inhibits the efficacy of the device to remain locked against an accidentally applied unidirectional force. The secondary locking mechanisms disclosed in the foregoing patents also occupy substantially greater height above the members to be connected than would ordinarily be required for the remainder of the latch mechanism. As a result, such secondary locking mechanisms detract from the low horizontal profile or "silhouette" of the overall latch.

U.S. Pat. Nos. 3,519,298 and 3,602,723 also disclose latches with secondary locking or anti-release mechanisms. These mechanisms also operate generally in planes perpendicular to the latch bases and protrude substantially above the general horizontal profile of the latches.

SUMMARY OF THE INVENTION

In the latch disclosed and claimed herein, the latch tension adjustment screw is fully accessible when the latch is closed from the rear of the latch through a channel-like opening defined by the latch handle. A secondary locking mechanism is mounted in the same area of the handle, but is offset laterally from the longitudinal center line of the latch and adjustment screw and does not, therefore, interfere with access to the adjustment mechanism. The secondary locking mechanism occupies no greater vertical depth than the adjustment mechanism, and does not detract from the low silhouette of the latch. The secondary locking mechanism is engaged in the same thumb-and-finger motion used to grasp the handle for opening, however, the force required to disengage a secondary lock is directed generally perpendicularly to the force required to lift the handle for opening the latch.

BRIEF DESCRIPTION OF THE DRAWINGS

FIG. 1 is a top plan view of the latch with certain portions cut away to disclose details of the operating mechanisms.

FIG. 2 is a side elevation of the latch shown in FIG. 1 and also having certain portions cut away.

FIG. 3 is a side elevation similar to FIG. 2, but showing the latch handle in the raised open position.

DESCRIPTION OF THE PREFERRED EMBODIMENT

In the drawing, a latch mechanism includes a latch assembly 10 attached to the surface of a member 12 and a strike plate 14 attached to an adjacent member 16 to be joined to member 12. The latch assembly includes a drawhook 18 adapted to engage a catch 20 on the strike plate 14 to draw members 12 and 16 together.

The latch assembly 10 includes a base 22 including flat, laterally extending mounting flanges 23 adapted to lie flush against and be attached to the surface of member 12, as with screws 24. Formed integrally with and extending perpendicularly from the mounting flanges 23 are a pair of side walls 26 joined at their upper edges by an integral top plate 28. The side walls 26 and top plate 28 form an elongated rectangular housing 29 for the tension adjusting mechanism to be described hereinafter.

A handle 30 includes a flat top surface 32 and two downwardly depending side flanges 34, the latter providing the usual thumb-and-finger engaging surfaces for operating the latch. The side flanges 34 extend forwardly of the top surface 32 to form a pair of spaced legs 36. The ends of the legs 36 are provided with holes in which are journaled the reduced ends 38 of a handle pivot pin 40. Pivot pin 40 extends through elongated aligned apertures 42 in the side walls 26 of the housing 29 to provide pivotal attachment of the handle 30 to the base 22. In the closed position of the latch shown in FIGS. 1 and 2 of the drawing, the legs 36 straddle the housing 29 and lie alongside and generally parallel to the side walls 26.

The drawhook 18 has a generally planar body 44 terminating in a curved hook 46 adapted to engage the catch 20 on strike plate 14. Extending rearwardly from the drawhook body 44 are a pair of spaced arms 48 adapted to straddle, in the closed position, the legs 36 of the handle and the housing 29 of the base. The ends of the drawhook arms 48 are pivotally attached to the legs 36 of the handle 30 with a pair of rivets 50 at a position on the legs 36 intermediate the handle pivot 40 and the side flanges 34. Further, the common axis of the rivets 50 lies slightly below, or closer to the mounting surface of member 12 than, the axis of the handle pivot pin 40 in the latched position. Thus, as the handle 30 is pivoted downwardly about its pivot 40 from the open position of FIG. 3 to the closed position of FIG. 2, the axis of the rivets 50 moves to an "overcenter" position. The operation of the latch 10 thusfar described is typical of overcenter latch construction wellknown in the art.

To provide for adjustment in the reach of the drawhook 18 and, correspondingly, the latch tension when closed, an adjustment screw 52 is disposed within the base housing 29. To provide a mount for the adjustment screw 52, the end wall 54 of the housing 29, which may conveniently comprise a downturned extension of the housing top plate 28, is provided with a hole 56 in which is journaled the shank 53 of the adjustment screw. The head 58 of the adjustment screw bears against the outer surface of the end wall 54 of the housing and the shank 53 extends into the housing 29 into threaded engagement with a tapped cross hole 41 in the pivot pin 40.

The tension in the drawhook 18 is transmitted to the adjustment screw 52 by way of the drawhook arms 48, handle legs 36 and pivot pin 40, and the full tension load is carried by the bearing engagement of the adjustment screw head 58 on the end wall 54 of the housing 29. As described previously, the pivot pin 40 extends through apertures 42 in the side walls 26 of the housing. Apertures 42 are elongated in the direction of the axis of the adjustment screw 52 and, as the screw is turned in the hole 56 in the housing end wall 54, its threaded connection with the cross hole 41 of the pivot pin 40 allows the pivot pin (and the pivotally connected handle 30 and drawhook 18) to be adjusted within the limits of the length of the elongated apertures 42. A coiled bias spring 60 is disposed around the shank 53 of the adjustment screw 52 and exerts a compressive force upon the pivot pin 40 at one end and the inside surface of the housing end wall 54 at the other end to position the adjustment screw and hold the head 58 thereof in contact with end wall 54. The force of the bias spring 60 on the pivot pin also serves to maintain the drawhook 18 in its adjusted position when unlatched. Otherwise, the unlatched drawhook could move freely by an amount equal to the distance from the pivot pin 40 in its adjusted position to the rear edges of the apertures 42 and, as a result, prevent proper initial engagement of the hook 46 and catch 20 as the drawhook is pivoted downwardly toward the strike plate 14 for relatching.

As may be seen in side elevation of FIG. 2, the latch assembly 10 presents a very shallow vertical profile or low "silhouette", which is extremely desireable in many applications where the vertical projection of the latch above the members 12 and 16 must be kept as small as possible The adjustment screw 52 is disposed completely within this low silhouette, yet its head 58 is fully accessible through the channel-like opening formed by the handle top surface 32 and side flanges 34, even when the latch is closed. To facilitate adjustment, the head 58 is conveniently provided with a hex recess 59 which is readily engageable by a screw driver, allen wrench, or similar tool 62 to vary the tension of the assembly in the latched position.

To secure the latch assembly thusfar disclosed against accidental opening, a secondary locking mechanism 64 is provided. The secondary locking mechanism is attached to the handle 30 and cooperates with a notch 66 in one side wall 26 of the housing 29 to realeasably hold the assembly in its latched position.

The secondary lock 64 includes an activating lever 67 having a generally L-shaped cross section with a flat upper surface 68 and an outer surface 70 disposed substantially perpendicular thereto. The upper surface 68 is disposed substantially within a narrow elongated slot 72 in a side flange 34 of the handle slightly below the top surface 32. At approximately its mid-point, the upper surface 68 is pivotally mounted to a vertically disposed locking pivot 74 attached to and depending downwardly from the handle top surface 32 on the inside thereof. The outer surface 70 of the lever 67 has the shape, when viewed in plan in FIG. 1, of a shallow V defining an obtuse angle. The outer surface 70 extends downwardly beyond the lower edge of elongated slot 72 and, as the lever 67 is pivoted about locking pivot 74, the legs of the V will alternately bear against the side flange 34 of the handle between the locked solid line and unlocked dotted line positions of FIG. 1. The angle of rotation between these positions is approximately equal to the supplement of the obtuse angle of the V.

A portion of the upper surface 68 of the lever 67 is cut away as at 76 to provide a locking detent 78 adapted to enter the notch 66 in the side wall 26 of housing 29 and prevent upward pivotal movement of the handle about the pivot pin 40 from its latched position. To maintain the locking lever 67 biased to the locked position, a torsion spring 79 is coiled about the locking lever pivot 74 and captured between the underside of the upper surface 68 and an enlarged head 82 at the end of pivot 74. The free ends 80 and 81 of the spring 79 bear against the inside surface of handle side flange 34 and the end of the lever 67 opposite the locking detent 78, respectively. The end 81 of spring 79 may be bent and hooked in a small hole 84 in the upper surface 68 of the lever 67. As a result, the detent is biased into locking engagement in the notch 66 while the opposite end of the lever is biased outwardly of the latch handle 30. The outwardly biased portion of outer surface 70 (one leg of the shallow V-form surface) provides a convenient thumb-or-finger engagable surface 71 for disengaging the secondary lock 64 by pressing the same inwardly against the bias of torsion spring 79.

The locking detent 78 is provided with an upwardly curved end 83 such that its rounded lower surface will ride over the corner formed by the junction of the housing top plate 28 and side wall 26 as the latch handle 30 is pivoted downwardly toward the latched position. The resultant against the bias of torsion spring 79 and snap back into the notch 66 as the handle reaches the overcenter latched position.

As can best be seen in FIG. 2, the mechanism of the secondary lock 64 occupies largely the same horizontal position above the member 12 on which the latch assembly 10 is mounted as the adjustment screw 52. However, due to the positioning of the secondary lock 64 offset laterally from the longitudinal centerline of the latch, it does not interfere with the operation of the adjustment screw 52 or in any way inhibit access to it for adjustment of tension in the latched position. Further, no part of the secondary lock 64 ever extends above the coplanar housing top plate 28, handle top surface 32, and drawhook body 44 in the latched position and, therefore, does not detract from the low silhouette of the latch.

The secondary lock 64 is conveniently opened in the same thumb-and-finger action used to grasp the side flanges 34 of the handle to open the latch. However, the force required to depress the surface 71 to unlock the latch must act generally perpendicularly to the force required to lift the handle 30, thereby minimizing the chance of accidental opening of the latch.

The top plate 23 of the housing 29 and the top surface 32 of the handle 30 provide a substantially continuous protective cover for both the tension adjustment and secondary lock mechanisms, further reducing the possibility of inadvertant movement or damage.

I claim:

1. In a latch for joining two adjacent members including, an integral base and housing adapted to be secured to one of the members; a handle pivot with its axis transversely disposed and extending through the forward portion of the housing; a handle having a pair of legs attached by their ends to the handle pivot outwardly of the housing and joined rearwardly of the housing by integral side flanges and a top surface to form a channel-like longitudinal opening; a drawhook disposed forwardly of the housing, adapted to engage a catch on the other of the members, and having a pair of rearwardly extending arms each pivotally attached at its end to one of the legs of the handle rearwardly of and nearer the base than the handle pivot; the improvement comprising:

(1) means in the housing permitting limited longitudinal movement of the handle pivot;

(2) an end wall closing the rear of the housing;

(3) an adjustment screw disposed longitudinally within the housing and having one end in threaded engagement with the handle pivot and a headed opposite end journalled in the housing end wall with its head bearing on the outer surface thereof;

(4) means on the head of the adjustment screw engageable externally of the latch by a tool extending through the channel-like opening in the handle on the axis of the screw for turning the same;

(5) locking means on the handle generally disposed and operable in a plane through the axis of the adjustment screw parallel to the base and offset laterally from said axis, said locking means adapted to releasably secure the handle to the housing against rotation thereof about the handle pivot.

2. A latch as defined in claim 1 wherein the housing comprises:

(1) a pair of lateral side walls extending perpendicularly from the base; and, (2) an integral top plate joining the side walls at their upper edges and lying parallel to the base.

3. A latch as defined in claim 2 wherein said means in the housing permitting limited longitudinal movement of the handle pivot comprises elongated aligned apertures in the side walls.

4. A latch as defined in claim 3 including a coiled bias spring surrounding the adjustment screw with the ends of said spring in compressive engagement with the handle pivot and the inner surface of the end wall.

5. A latch as defined in claim 2 wherein the top surface of the handle and the top plate of the housing are coplanar.

6. A latch as defined in claim 5 wherein the locking means comprises:

(1) a slot in a side flange of the handle adjacent one side wall of the housing;

(2) a locking pivot depending vertically from the top surface of the handle within the channel-like opening;

(3) a lever disposed in the slot and pivotally attached intermediate its ends to the locking pivot;

(4) a notch in the side wall of the housing adjacent one end of the lever;

(5) a detent on said one end of the lever adapted to engage the notch;

(6) a finger-engageable surface on the other end of the lever disposed outside the handle side flange; and, (7) means operatively attached to the handle and the lever for biasing the detent into engagement with the notch.

* * * * *